US006375514B1

(12) United States Patent
Chih et al.

(10) Patent No.: US 6,375,514 B1
(45) Date of Patent: Apr. 23, 2002

(54) WIRE CONNECTED MODULAR JACK CONNECTOR ASSEMBLY

(75) Inventors: Kuo-Hua Chih, Tu-Chen; Peter Kuo, Chung-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/749,026

(22) Filed: Dec. 26, 2000

(30) Foreign Application Priority Data

Oct. 24, 2000 (TW) ..... 89218469 U

(51) Int. Cl.[7] ..... H01R 24/06
(52) U.S. Cl. ..... 439/676
(58) Field of Search ..... 439/676, 701, 439/607–610, 490, 489

(56) References Cited

U.S. PATENT DOCUMENTS 5,790,660 A * 8/1998 Vlaeminck ..... 439/676
6,079,996 A * 6/2000 Arnett ..... 439/676
6,095,851 A * 8/2000 Laity et al. ..... 439/676
6,174,194 B1 * 1/2001 Bleicher et al. ..... 439/676

* cited by examiner

*Primary Examiner*—Gary Paumen
(74) *Attorney, Agent, or Firm*—Wei Te Chung

(57) ABSTRACT

A modular jack connector assembly (1) comprises an insulative housing (2) having two receiving spaces (20, 21) arranged side byside, a plurality of terminals (5) received in the receiving spaces, an terminal block (6) with a plurality of wires (7) interwoven therearound, a LED (light emitting diode) device (40) assembled on the housing, and a shield (3) enclosing the housing. The terminal block comprises a main body (60) and two inserts (63). The main body comprises a first part (601) and a second part (602), each part defining a plurality of through holes (61, 640) adapted to accept the wires therethrough and a receiving channel (641) adapted to receive an insert whereby the inserts fix the wires to the terminal block. Each wire electrically contacts with a corresponding terminal in a slot (65) defined in the main body.

1 Claim, 5 Drawing Sheets

WIRE CONNECTED MODULAR JACK CONNECTOR ASSEMBLY

BACKGROUND OF THE INVENTION

1. Field of the Invention

The present invention relates to a modular jack connector assembly, and particularly to a modular jack connector assembly having electrical terminals of a modular jack electrically connected to a wire using a solderless method.

2. Description of the Related Art

A modular jack connector assembly is used for mating with a modular plug connector for transmitting information between two electronic devices. The modular jack comprises a plurality of electrical terminals therein. One end of each terminal is adapted to mate with an RJ plug; the other end of each terminal can be adapted to terminate to wires. In the prior art, there are three ways to terminate the terminals of the modular jack to the wires. The first way is to solder the terminals and the wires to a printed circuit board, whereby the terminals and the wires are electrically connected together. This method requires, an additional printed circuit board and the integrity of the connection between the wires and the terminals is not bent. The second way is to cramp the wires and the terminals together using ferrules. This way is costly both in additional components and in assembly time required. The third way is to use insulative displacement connection (IDC) technology. Each terminal of the modular jack pierces an insulation jacket surrounding a center conductor of each wire and electrically contacts the center conductor. To use IDC, the terminals and the housing of the connector need a complicated structure to achieve the electrical connection.

Hence, an improved modular jack connector is required to overcome the disadvantages of the prior art.

BRIEF SUMMARY OF THE INVENTION

A first object of the present invention is to provide a modular jack connector assembly for connecting to wires which has a simple configuration.

A second object of the present invention is to provide a modular jack connector assembly for connecting to wires which requires less assembly space.

A modular jack connector assembly comprises an insulative housing having two receiving spaces arranged side by side, a plurality of terminals received in the receiving spaces, a terminal block with a plurality of wires interwoven therearound, a light emitting diode (LED) device assembled on the housing, and a shield enclosing the housing. The terminal block comprises a main body and a pair of inserts. The main body comprises a first part and a second part and each part defines a plurality of through holes adapted to allow threading of the wires therethrough and a receiving channel adapted to receive one of the inserts therein whereby the inserts fix the wires to the terminal block. Each wire electrically contacts with a corresponding terminal in a slot defined in the main body.

Other objects, advantages and novel features of the invention will become more apparent from the following detailed description of the present embodiment when taken in conjunction with the accompanying drawings.

DETAILED DESCRIPTION OF THE INVENTION

Figure 1:
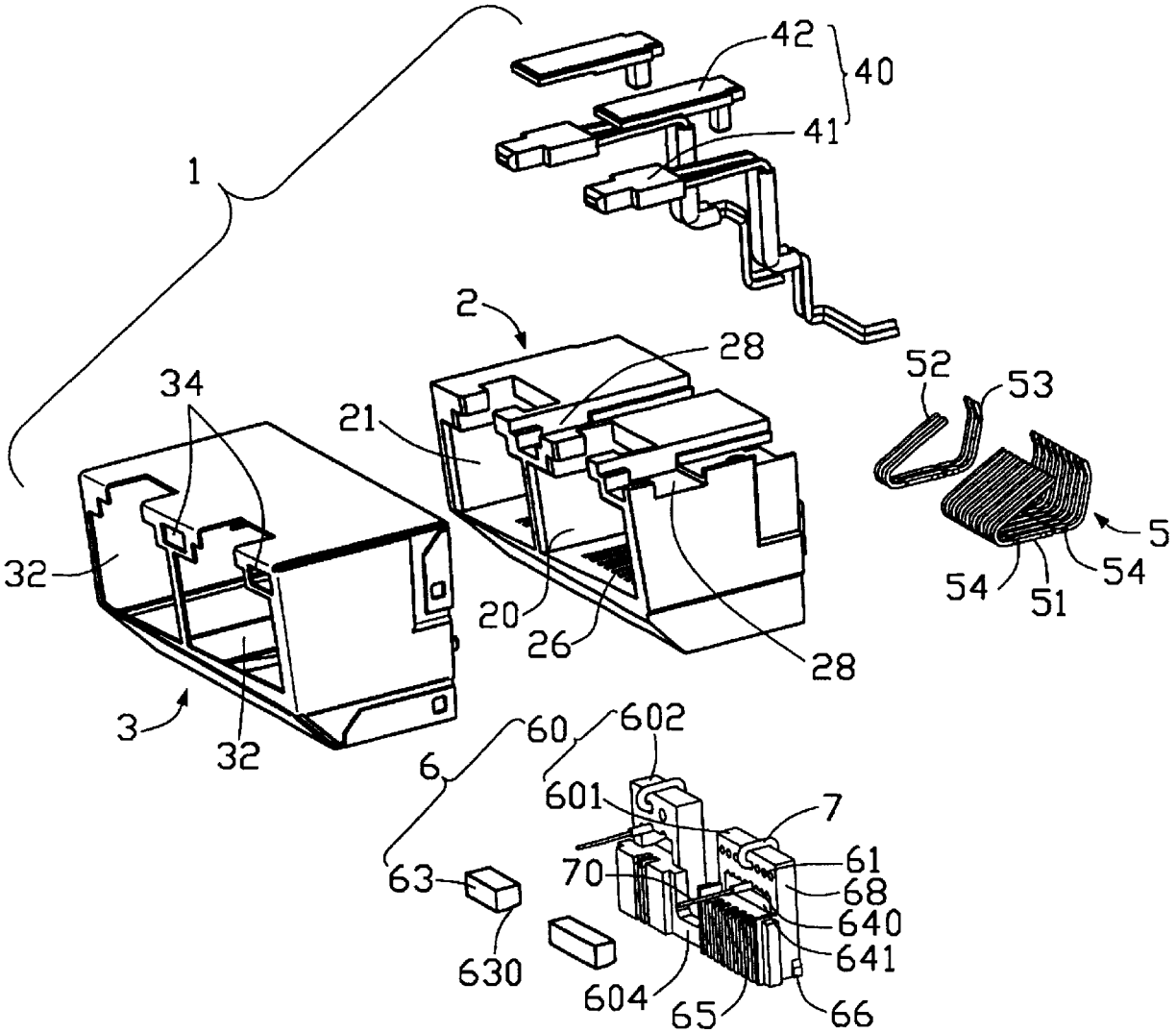
FIG. 1 is an exploded view of a modular jack connector assembly in accordance with the present invention.

Referring to FIG. 1, a modular jack connector assembly 1 in accordance with the present invention comprises an insulative housing 2, a plurality of terminals 5, a terminal block 6, a plurality of wires 7 (only two shown), a light emitting diode (LED) device 40 and a metal shield 3.

The housing 2 is rectangular in shape and defines two receiving spaces 20, 21 arranged side by side for receiving complementary RJ-45 and RJ-11 modular plugs (not shown), respectively. A plurality of passageways 26 is defined in a bottom plate of the housing 2 communicating with the receiving spaces 20, 21. A pair of receiving channels 28 is defined in a lateral side and in a middle of a top plate of the housing 2.

Each terminal 5 is bent and forms a horizontal body 51, a contact portion 52 upwardly and rearwardly extending from a front end of the horizontal body 51 and a touch portion 53 extending substantially vertically upwardly from a rear end of the body 51. A plurality of barbs 54 is formed on two sides of each of the bodies 51 of the terminals 5.

Figure 2:
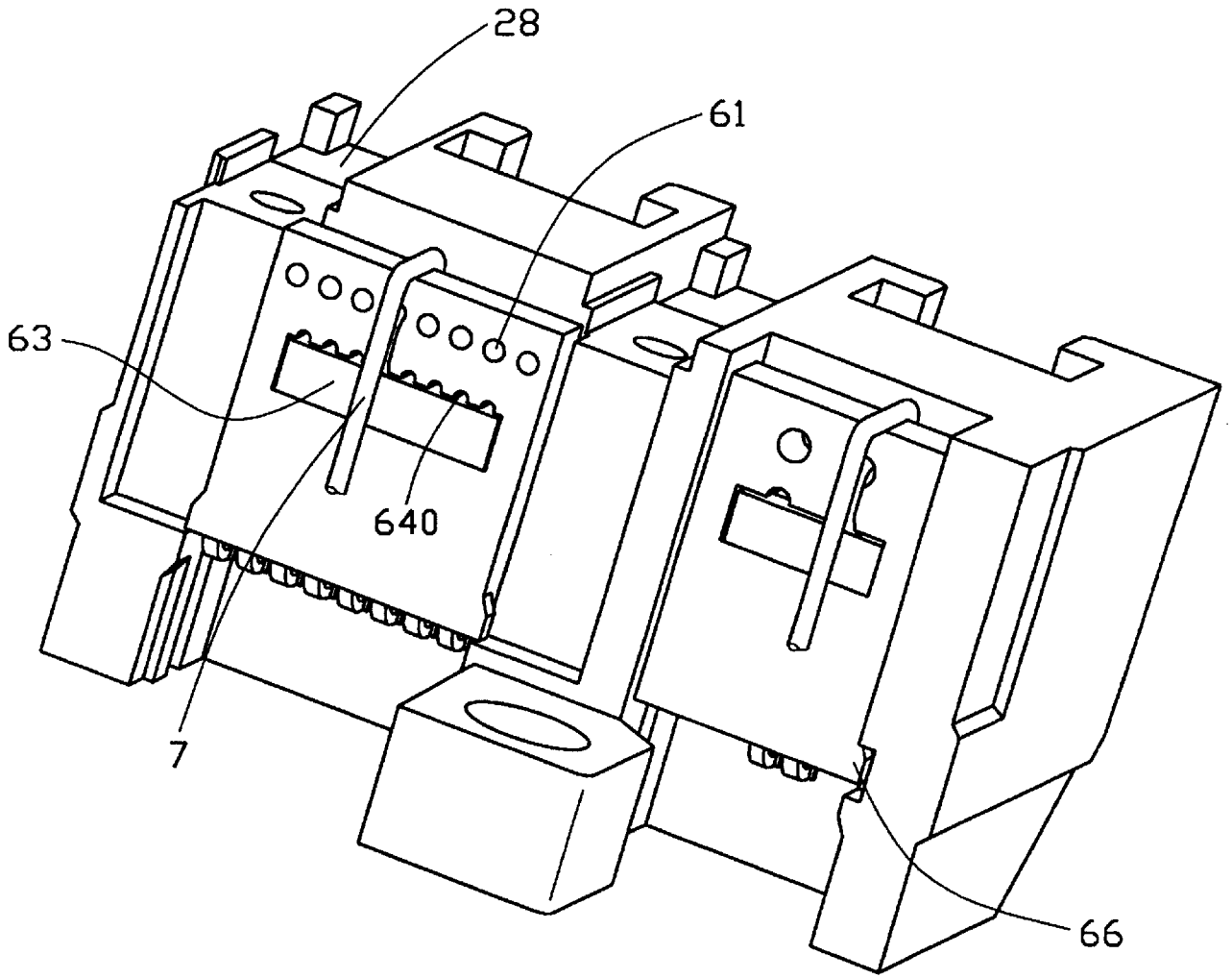
FIG. 2 is a partly assembled rear view of the modular jack connector assembly without a LED device and a shield.
Figure 4:
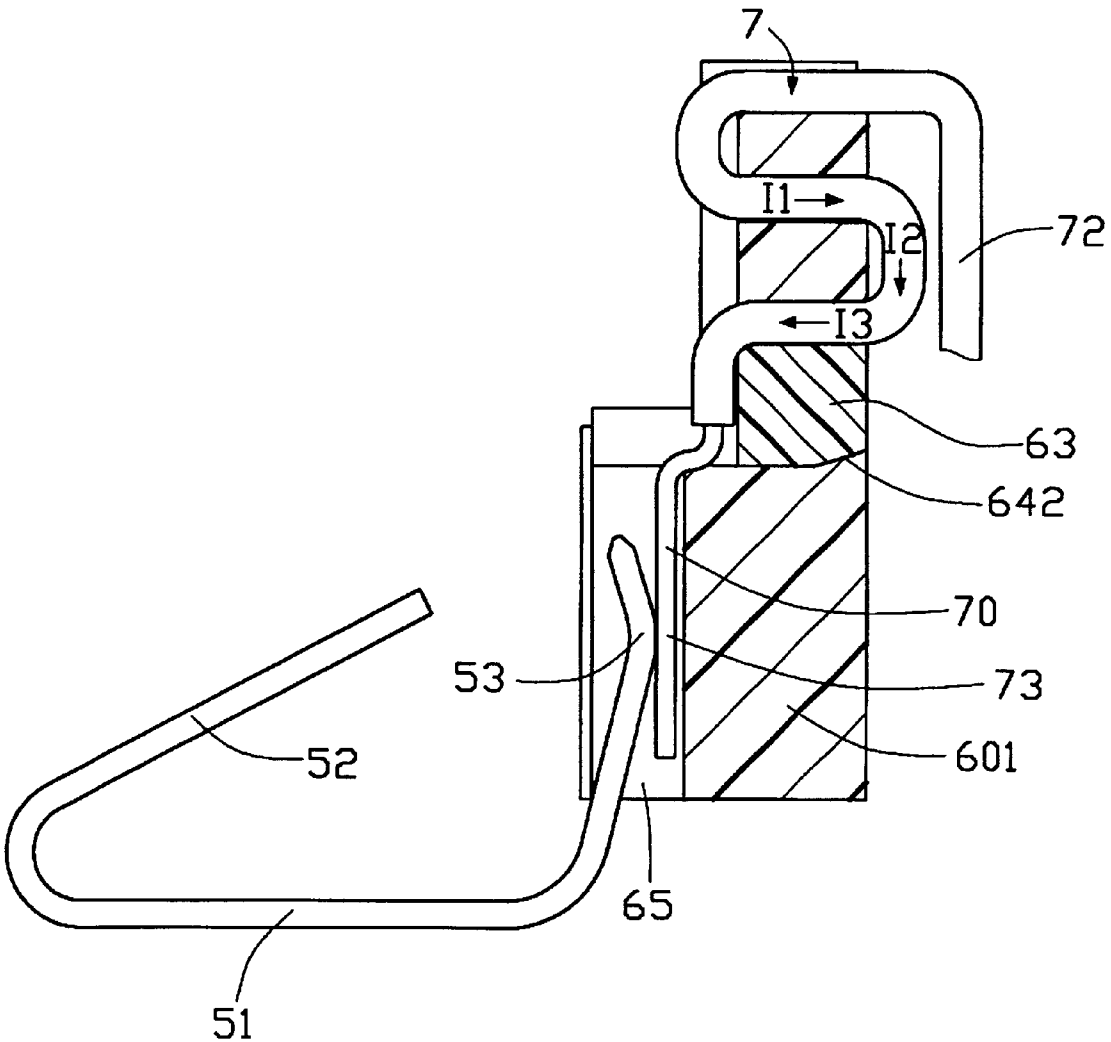
FIG. 4 is a cross sectional view taken along line 4—4 of FIG. 3.
Figure 5:
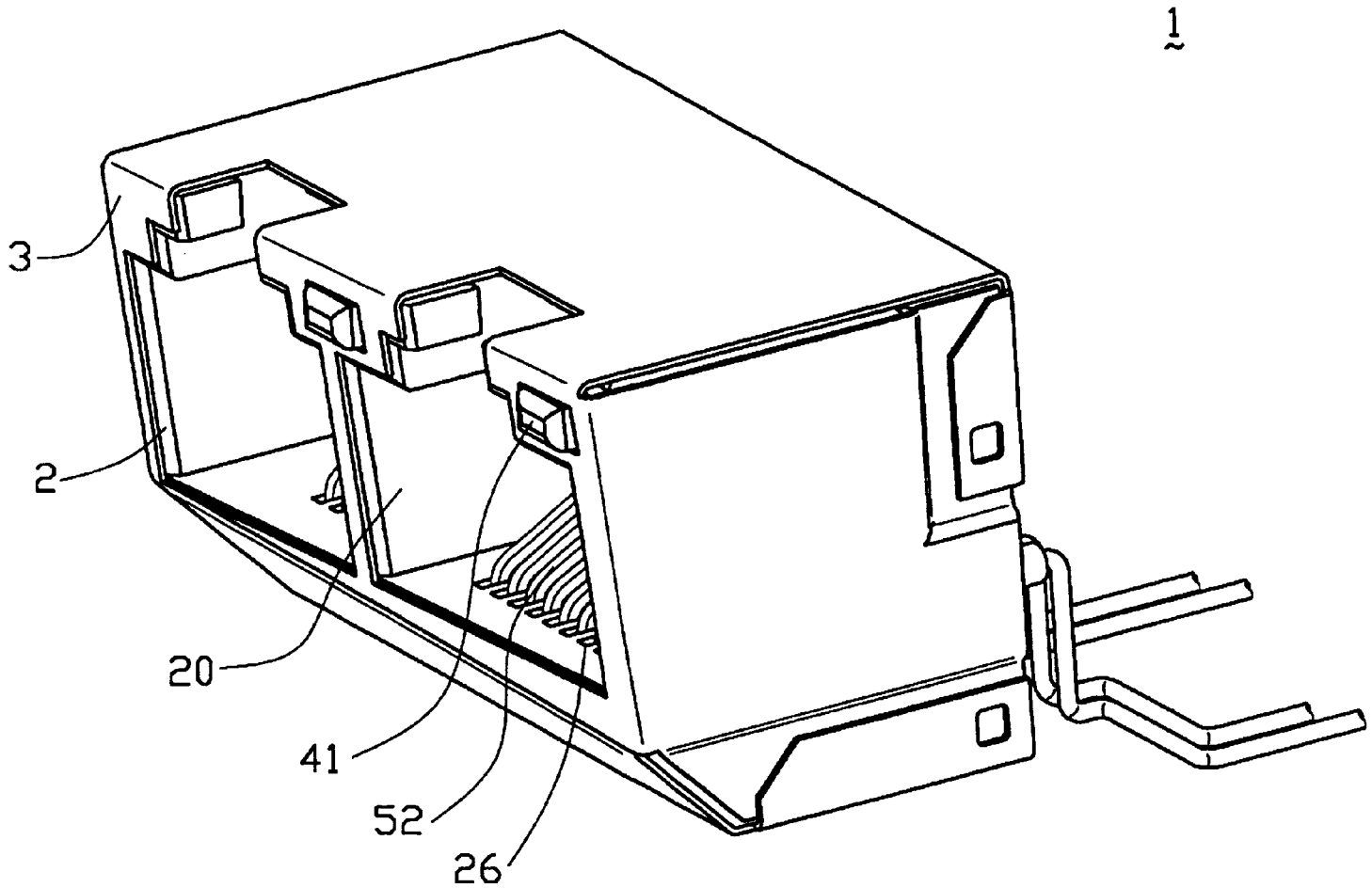
FIG. 5 is an assembled view of the modular jack connector assembly of FIG. 1.

Referring to FIG. 1 and FIG. 2, the terminal block 6 comprises a main body 60 and two inserts 63. The main body 60 comprises a first part 601 and a second part 602 connected together by a connection portion 604. The first part 601 defines a plurality of circular through holes 61 around an upper end thereof, a plurality of semicircular through holes 640 located beneath corresponding circular through holes 61, and a receiving channel 641 under the semicircular through holes 640 and communicating with the semicircular through holes 640. An upwardly inclined rear portion face 642 is formed by the first part 601 bounding a rear, lower portion of the receiving channel 641 (FIG. 4). A plurality of slots 65 is vertically defined in a front face (not labeled) of the first part 601 below the receiving channel 641. An engaging protrusion 66 is formed at a lower end of each of lateral sides 68 of the main body 60. The configuration of the second part 602 is similar to that of the first part 601 except that it has fewer circular through holes, semicircular through holes and slots than the first part 601, and has a smaller receiving channel 641. The inserts 63 each have a wedged rear portion 630 for readily inserting into a corresponding receiving channel 641. The insert for the first part 601 is larger than the insert for the second part 602.

Figure 3:
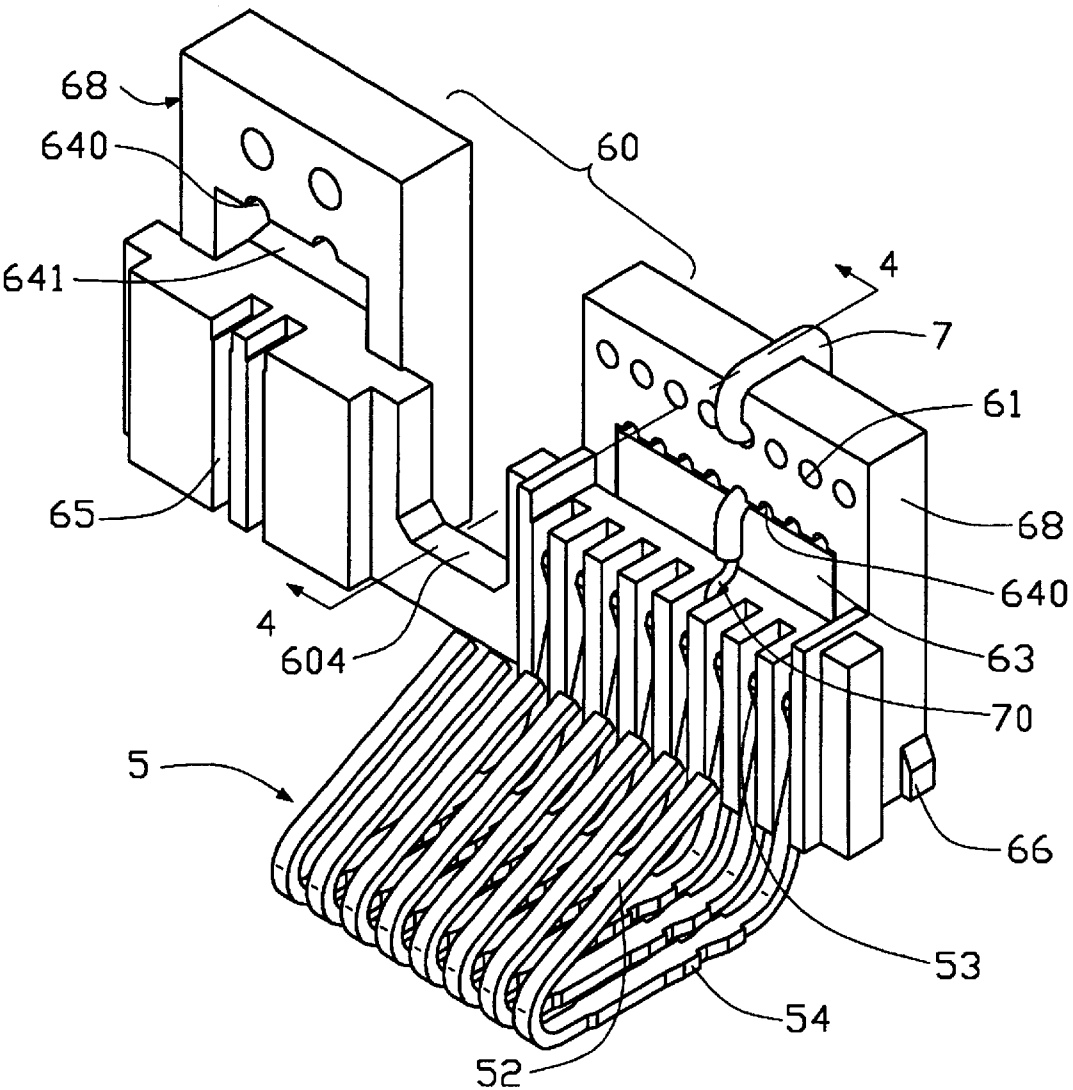
FIG. 3 is an enlarged perspective view showing the detail of connection between terminals and wires of the modular jack connector assembly.

Referring to FIGS. 3 and 4, each wire 7 has a center conductor 70 and an insulation jacket 72 surrounding the center conductor 70. The center conductor 70 has an exposed end 73. The wires 7 are interwoven with the main body 60 by extending the exposed end 73 of each wire 7 from a rear of the main body over a top of the main body to a front thereof. The wire 7 is then extended rearwardly through the circular through hole 61 (as indicated by arrow I1) to the rear of the main body 60. Afterwards, the wire 7 is extended downwardly (as indicated by arrow I2), and finally forwardly through the semicircular through hole 640 (as indicated by arrow I3) from the rear of the main body 60 to the front of the main body 60. The inserts 63 are inserted into the receiving channels 641 with the wedged rear portions 630 of the inserts 63 stopped at the inclined rear portion faces 642 of the receiving channels 641, thereby preventing the inserts 63 from being pushed out a back of the receiving channels 641, and the inserts 63 tightly press the wires 7 upward against the main body 60 into the semicircular though holes thereby fixing the wires 7 to the main body 60. The exposed ends 73 of the wires 7 are then received in corresponding slots 65.

The LED device 40 comprises a pair of LEDs 41 and a pair of cover plates 42 for assembling the LEDs 41 to the housing 2.

Referring to FIG. 1, the shield 3 defines two openings 32 corresponding to the receiving spaces 20, 21 and a pair of slots 34 corresponding to the channels 28 of the insulative housing 2.

Referring to FIG. 2 to FIG. 5, in assembly, the terminals 5 are inserted into the passageways 26 of the receiving spaces 20, 21 with the barbs 54 engaging with two side walls of the passageways 26. The exposed end 73 of the center conductor 70 of each wire 7 is inserted into the corresponding slot 65. The terminal block 6 is assembled into the housing 2 from rear of the housing 2 with the engaging protrusions 66 engaging with inner sides of the housing 2. The touch portion 53 of each terminal 5 respectively contacts the exposed end 73 of a corresponding wire 7 in the slot 65 of the terminal block 6. The LEDs 41 are inserted into the channels 28 of the housing 2 with the cover plates 42 correspondingly covering and engaging with the channels 28 of the housing 2. The metal shield 3 finally encloses the housing 2; thus the modular jack connector assembly 1 is assembled.

In the present invention, the wires 7 are not easy to pull from the terminal block 6 after they have been assembled in the connector assembly, not even when the wires 7 are subjected to a force normal to a rear of the terminal block 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector assembly comprising:

an insulative housing defining at least one receiving space for receiving a complementary modular plug;

a plurality of terminals received in the receiving space and each terminal comprising a contact portion for electrically engaging with the complementary modular plug and a touch portion at an opposite end from the contact portion;

a terminal block assembled in the receiving space and defining a plurality of slots therein, each slot receiving the touch portion of a corresponding terminal; and a plurality of wires interwoven into the terminal block, the wires each having a center conductor surrounded by an insulation jacket, the center conductor having an exposed end extending into a corresponding slot and engaging with the touch portion of a corresponding terminal;

wherein the terminal block comprises a main body and a plurality of inserts received in the main body;

wherein the main body defines a plurality of circular through holes and a receiving channel under the circular through holes, and each wire is threaded through each corresponding circular through hole from the front of the terminal block and then extends downwardly and finally extends through the receiving channel to the front of the main body;

wherein the insert is inserted into the receiving channel and fixes the wires in place;

wherein the insert defines a wedged rear portion at a lower edge thereof, and the receiving channel defines an inclined face corresponding to the wedged rear portion which prevents the insert from being pushed out a back of the receiving channel;

wherein a plurality of semicircular through holes corresponding to the circular through holes are defined between the circular through holes and the receiving channels, the semicircular through holes communicating with the corresponding receiving channels, and the wires extending from a rear of the main body are partly fixed in the semicircular through holes by the inserts;

wherein the main body comprises a first part and a second part connected by a connection portion, the circular through holes and the semicircular through holes and the receiving channels are together defined in the first part and the second part;

wherein the housing comprises two receiving spaces arranged side by side to receive the first part and the second part of the main body.

* * * * *